US005765788A

United States Patent [19]

DeCanio

[11] Patent Number: 5,765,788

[45] Date of Patent: Jun. 16, 1998

[54] TORCH HOSE SUPPORT DEVICE

[76] Inventor: Paul Joseph DeCanio, 35 Franklin Ave., Brentwood, N.Y. 11717

[21] Appl. No.: 777,707

[22] Filed: Dec. 20, 1996

[51] Int. Cl.[6] ..... A62C 13/76

[52] U.S. Cl. ..... 248/79; 248/312

[58] Field of Search ..... 248/79, 75, 89, 248/213.2, 219.2, 224.7, 225.21, 290.1, 301, 312

[56] References Cited

U.S. PATENT DOCUMENTS

| | | | |
|---|---|---|---|
| 1,566,597 | 12/1925 | Harman . | |
| 2,725,208 | 11/1955 | Bova | 248/89 |
| 3,240,407 | 3/1966 | Boak | 224/42.38 |
| 3,370,624 | 2/1968 | Terrill | 248/312 |
| 4,422,435 | 12/1983 | Spell | 248/312 |
| 4,506,853 | 3/1985 | Cathey | 248/79 |
| 5,584,345 | 12/1996 | Joy | 248/79 |

*Primary Examiner*—Leslie A. Braun
*Assistant Examiner*—Anita M. King

[57] ABSTRACT

A device for holding the torch twin hose in an easy accessable location while the torch is in the use mode or not. The device includes a body structure having a top horizontal surface and a bottom horizontal surface and having internal circumferential threads there between and a external circumferential surface in which a hook member is attached thereon. The device maybe conveniently made from a metallic material.

1 Claim, 1 Drawing Sheet

TORCH HOSE SUPPORT DEVICE

BACKGROUND OF THE INVENTION

1. Field of the Invention

The invention relates generally to a device for holding the torch twin hose in a safe accessable location while the torch is in use or not.

2. Description of the Prior Art

Torch twin hoses currently in use are stored by being wrapped around the oxy-acetylene cylinders. The problem with this is that coilset develops in the hose which will shorten the life of the hose, another problem with this is that for safety reasons the entire length of the torch twin hose must be fully unwrapped from the oxy-acetylene cylinders when the torch is in use. This invention eliminates this problem.

SUMMARY OF THE INVENTION

The invention relates generally to a device that allows the torch twin hose to be safely and properly stored on the oxygen cylinder while positioned at any rotational position about its concentrical axis while the torch is in use or not.

It is an object of this invention to provide an inexpensive device which will allow more efficient use of a gas torch, which will increase worker productivity.

DESCRIPTION OF THE PREFERRED EMBODIMENT

Figure 1:
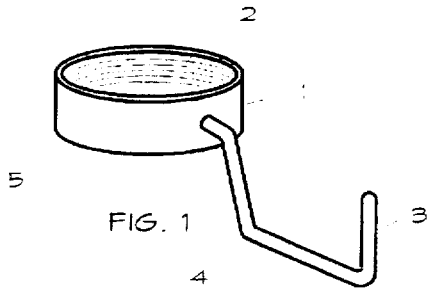
FIG. 1 is a elevation view showing an embodiment of the torch hose support device.
Figure 2:
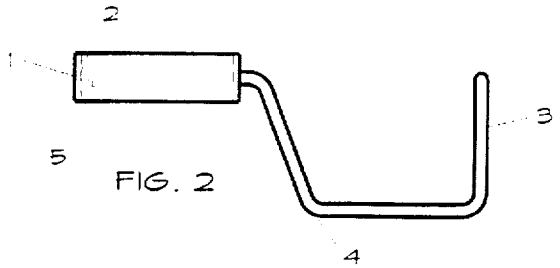
FIG. 2 is a side view showing an embodiment of the torch hose support device.
Figure 3:
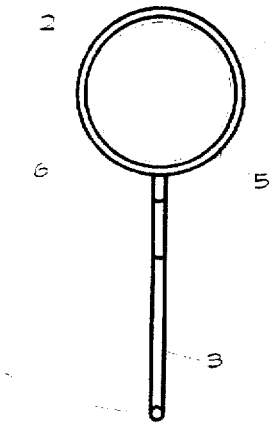
FIG. 3 is a top view showing an embodiment of the torch hose support device.
Figure 4:
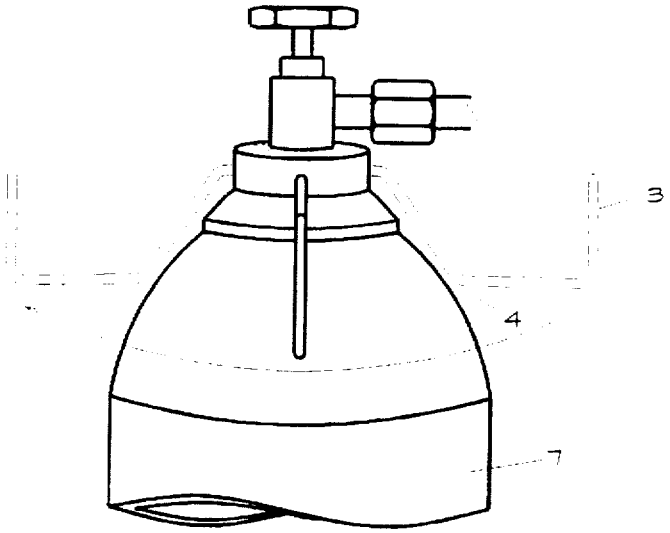
FIG. 4 is a front view showing an embodiment of the torch hose support device installed on the oxygen cylinder.
Figure 5:
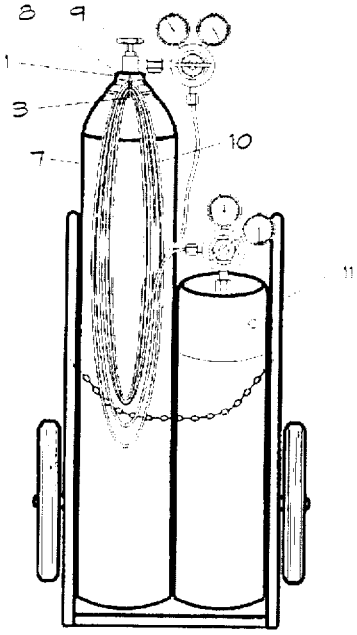
FIG. 5 is a front view showing yet another embodiment of the torch hose support device installed on the oxygen cylinder of the oxy-acetylene torch setup.

Referring to FIGS. 1,2,3,4 and 5, an embodiment of the invention is shown in which the Torch Hose Support Device is removably installed to the oxygen cylinder 7. The torch hose support device is comprised of a body structure 1 and a hose hook member 3.

In this embodiment, a fastening means which is shown as internal circumferential threads 2 of the body structure 1 which fastens the embodiment to the oxygen cylinder 7 by means of the internal circumferential threads 2 which communicate with the oxygen cylinder 7 safety cap threads 8, the external circumferential surface 5 of the body structure 1 has a hook member 3 attached thereon.

The internal opening 6 of the body structure 1 is large enough to fit over the oxygen cylinder valve handle 9. The embodiment is installed when the body structure 1 is turned in a clockwise direction which the internal circumferential threads 2 would communicate with the oxygen cylinder 7 safety cap threads 8. The embodiment is in the installed mode when the hose hook 3 bottom surface 4 makes contact with the oxygen cylinder 7, then the hose hook 3 can be resistibly rotated 360 degrees concentric to the oxygen cylinder 7 which would hold the twin hose 10 in a safe desired location of the oxy-acetylene torch setup 11.

Although one detailed embodiment of the invention is illustrated in the drawings and previously described in detail, this invention contemplates any configuration and design of components which will accomplish the equivalent result.

I claim:

1. A torch hose support device, which comprises:

(a) a body structure being formed as a substantially circular shaped element having a top edge surface, a bottom edge surface and an outer face surface, said circular shaped element having an internal, axially extending opening defining, an inner face, said inner face being formed with continuous internal circumferential threads thereon extending from said top educe surface to said bottom edge surface; and (b) a substantially U-shaped hook member having first and second side elements secured at their first ends to a base element, a second end of the first side element being permanently secured to the outer surface of said circular shaped element by an element member extending substantially orthogonal to said outer face surface and acutely to one of said side elements, said one of said side elements extending acutely from said base element, another one of said side elements extends substantially orthogonal to said base element; whereby said U-shaped hook member is adapted to have a clearance from a bullet shaped top of a cylinder during initial assembly of the torch hose support device to the cylinder and whereby a lower portion of the first side element is adapted to engage the cylinder during final assembly to thereby resistant the rotation of the torch hose support device during use.

* * * * *